US005472021A

United States Patent [19]

Tsao et al.

[11] Patent Number: 5,472,021

[45] Date of Patent: Dec. 5, 1995

[54] NONSPILL BOTTLED WATER REPLACEMENT SYSTEM WITH DISPOSABLE SEAL MEMBER

[75] Inventors: Chein-Hwa Tsao, Saratoga; Robert N. Lee, Palo Alto, both of Calif.

[73] Assignee: Innostar, Inc., San Jose, Calif.

[21] Appl. No.: 57,335

[22] Filed: May 4, 1993

Related U.S. Application Data

[63] Continuation-in-part of Ser. No. 13,778, Feb. 5, 1993, Pat. No. 5,363,890.

[51] Int. Cl.[6] ..... B65D 47/00

[52] U.S. Cl. ..... 141/1; 141/2; 141/21; 141/351; 141/364; 222/1; 222/491; 222/541.1; 222/541.6; 215/253

[58] Field of Search ..... 141/1, 114, 319, 141/363–366, 74–76, 80, 21, 351, 352.2, 329–330; 220/256–258; 215/31, 32, 253, 251; 222/1, 202, 203, 212, 213, 54, 491, 541, 531, 532; 62/389

[56] References Cited

U.S. PATENT DOCUMENTS

| | | | |
|---|---|---|---|
| 733,449 | 7/1903 | Willsie | 141/75 |
| 2,622,780 | 12/1952 | Ackerman | 141/76 |
| 3,118,573 | 1/1964 | Johnson | 222/212 |
| 3,399,806 | 9/1968 | Lucas | 222/54 X |
| 3,952,741 | 4/1976 | Baker | 222/54 X |
| 4,114,653 | 9/1978 | Carlin | 222/54 X |
| 4,121,734 | 10/1978 | Soong et al. | 222/54 |
| 4,266,687 | 5/1981 | Cummings | 215/251 |
| 4,378,069 | 3/1983 | Franco | 222/541 X |
| 4,597,423 | 7/1986 | Chenot | 141/330 |
| 4,696,328 | 9/1987 | Rhodes, Jr. | 141/1 |
| 4,789,082 | 12/1988 | Sampson | 222/1 |
| 4,789,082 | 12/1988 | Sampson | 222/1 |
| 4,792,069 | 12/1988 | Nantin et al. | 222/574 X |
| 4,938,390 | 7/1990 | Markva | 222/212 X |
| 4,949,857 | 8/1990 | Russell | 215/253 |
| 4,953,729 | 9/1990 | Kloosterhouse | 141/364 X |
| 4,984,700 | 1/1991 | Knickerbocker | 215/251 X |
| 5,014,888 | 5/1991 | Bryan | 222/541 |
| 5,083,675 | 1/1992 | Aubanesi | 220/258 X |
| 5,1054,986 | 4/1992 | Pham et al. | 222/145 |

FOREIGN PATENT DOCUMENTS

| | | | |
|---|---|---|---|
| 0617074 | 3/1961 | Canada | 222/213 |

*Primary Examiner*—J. Casimer Jacyna
*Attorney, Agent, or Firm*—James J. Leary; Carol A. Duffield

[57] ABSTRACT

A membrane closure which prevents spillage during installation of a water bottle onto a dispenser. The membrane closure provides a water tight seal which is opened after the water bottle is installed by generating a hydraulic shock wave within the bottle. The first embodiment of the membrane seal is folded multiple times then unfolds when subjected to a hydraulic shock wave. The second embodiment has a frangible membrane seal which bursts when subjected to a hydraulic shock wave. The membrane may be weakened along a desired rupture pattern. The third embodiment has a membrane seal attached to the water bottle with two different adhesives, a releasable adhesive which releases when the shock wave is initiated, and a permanent adhesive that prevents the seal from completely detaching from the water bottle. Three methods are presented for generating the hydraulic shock wave to open the membrane seal. In the first method, the water bottle is positioned just above the water dispenser and lowered rapidly. In the second method, the bottle is placed on the dispenser and tipped so that one shoulder of the bottle is just above the top opening of the dispenser, then the bottle is allowed to settle back into place. These two methods create an inertial shock wave when the bottle comes to rest. In the third method, the bottle is placed on the dispenser with the seal intact, and the user strikes the top or the sides of the water bottle to create the hydraulic shock wave.

10 Claims, 10 Drawing Sheets

NONSPILL BOTTLED WATER REPLACEMENT SYSTEM WITH DISPOSABLE SEAL MEMBER

RELATIONSHIP TO OTHER APPLICATIONS

This patent application is a continuation-in-part of patent application Ser. No. 08/013,778, filed Feb. 5, 1993, now U.S. Pat. No. 5,363,890, the specification of which is hereby incorporated by reference in its entirety.

FIELD OF THE INVENTION

The present invention relates in general to water dispensers of the type which have a water bottle that is inverted and loaded onto a water dispenser. More specifically, it relates to a device for preventing spillage when the water bottle is inverted during installation and a method for its use.

BACKGROUND OF THE INVENTION

Many offices, stores, factories and homes are equipped with drinking water dispensers for their members. While some dispensers are plumbed permanently to a tap water supply, others employ a user replaceable supply, such as an inverted water bottle removably mounted on top of the dispenser. Examples of the design of such dispensers are U.S. Pat. No. 3,698,603 issued October 1972 to Radcliffe and U.S. Pat. No. 4,664,349 issued May 1987 to Johansen.

One of the primary difficulties with such prior art dispenser systems employing an inverted bottle lies in the procedure of user replacement of a used bottle. At this time, a nearby full bottle has to be substituted in its place. Typically the bottles are of 5 gallon capacity and therefore very heavy. This means that, after the user removes the used bottle and opens the cap of the full bottle, the user would have to lift the full bottle and, in one very quick movement, invert it and insert its neck accurately into the intake opening on top of the dispenser and maneuver the body of the bottle into vertical position for normal operation. Any less than good execution of this exceptionally demanding procedure will result in excessive water spillage plus possible personal injury. In any case, the current procedure always wastes some water through unavoidable spillage, in addition to being dangerous to the user.

Two prior patents taught the idea of, upon loading of the full container, piercing an otherwise sealing member of the container thus establishing either the flow of one single fluid or the simultaneous flow of two different fluids from the supply bottle. The piercing element being a permanent part of the dispenser. These are U.S. Pat. No. 1,248,704 issued October 1916 to Pogue and U.S. Pat. No. 4,676,775 issued June 1987 to Zolnierczyk, et al. But the implementation of these methods would require the modification of the existing dispensers and bottles which is undesirable.

Other prior art patents have taught the use of a frangible, burstable or releasable membrane seal attached to a squeezable plastic bottle, such as a container for motor oil. The membrane prevents spillage of the contents as the bottle is inverted. Once the bottle is in place, the bottle is squeezed to create an internal pressure which opens the seal, allowing the contents to pour out. Examples of these can be found in U.S. Pat Nos.: 5,105,986 to Pham et al. for Non-Spill Inverter Devices, Containers, and Methods, 4,938,390 to Markva for a Liquid Storage Container with Dispensing Closure, 4,789,082 to Sampson for Container Discharge Control, and 4,696,328 to Rhodes, Jr. for Spillage Prevention. These devices and methods are unsuitable for water bottles which are made of rigid materials such as glass, polycarbonate or other rigid plastics. These rigid containers resist being squeezed which prevents the user from generating enough internal pressure to burst the seal.

OBJECTIVES AND SUMMARY OF THE INVENTION

A principal objective of the present invention is to provide a device which prevents spillage when a water bottle is inverted for installation onto a water dispenser. It is also an objective to provide a method for establishing the flow of water from the water bottle into the water cooler after the bottle has been inverted and installed onto the water dispenser. It is preferable that the device be buildable from low cost materials so that it does not add significantly to the cost of the water bottle and so that it can be made disposable if desired. The device should also be buildable from recyclable materials. Another objective of the invention is to provide the device in embodiments which are suitable for automated installation by the water bottling company and for hand application by the end user.

Accordingly, the present invention takes the form of a membrane closure which initially provides a water tight seal on the mouth of the water bottle, but which can be opened after the water bottle is installed by generating a hydraulic shock wave within the bottle to open the seal and allow water to flow from the bottle. The first embodiment has a membrane seal which is folded multiple times to create an initially water tight seal. The membrane seal unfolds when it is subjected to a hydraulic shock wave, thereby opening the seal and allowing the water to flow out. The second embodiment has a membrane seal made of a frangible material which bursts when it is subjected to a hydraulic shock wave. The membrane may be creased, scored, perforated or otherwise weakened along a desired rupture pattern. The third embodiment has a membrane seal which is adhesively attached to the mouth of the water bottle. When the membrane seal is subjected to a hydraulic shock wave the seal detaches from the mouth of the bottle allowing the water to flow out. The membrane seal may be attached with two different adhesives, the first being a releasable adhesive, and the second being a stronger, more permanent adhesive that prevents the seal from becoming completely detached from the water bottle. Any of the embodiments of the invention may be used in combination with the tear-away plastic caps currently used for water bottles. The membrane provides a hermetic sanitary seal under the plastic cap.

The water bottle is made of a rigid material, which prevents the user from squeezing the bottle to release the seal, as in the prior art methods. In order to release the seal, the user generates a hydraulic shock wave in the water inside the bottle. The shock wave opens the seal and allows the water to flow from the bottle. Three methods are presented for generating the necessary hydraulic shock wave. In the first method, the water bottle is positioned a few inches above the top opening of the water dispenser. The bottle is lowered rapidly onto the dispenser opening, which creates an inertial shock wave when the bottle comes to rest. In the second method, the water bottle is placed on the top opening of the water dispenser with the seal intact. The bottle is then tipped so that one shoulder of the bottle is a few inches above the top opening of the water dispenser, then the bottle is allowed to settle back into place, which creates an inertial shock wave when the bottle comes to rest. In the third method, the water bottle is placed on the top opening of the water dispenser with the seal intact, and the user strikes the bottom or the sides of the water bottle to create is the hydraulic shock wave. With any one of the disclosed methods, the user can carefully place the water bottle on or over the water dispenser without danger of spillage. Then, once the bottle is safely in place, the user can initiate a hydraulic shock wave which opens the seal and allows the water to flow out.

It should be noted that the term "hydraulic shock wave" is used herein in its conventional sense which has a specific, established scientific meaning that is well understood by those of ordinary skill in the art. The definition of a "shock wave" as defined by the McGRAW-HILL DICTIONARY OF SCIENTIFIC AND TECHNICAL TERMS, and as used herein, is:

> "shock wave [PHYS] A fully developed compression wave of large amplitude, across which density, pressure, and particle velocity change drastically."

This is in marked contrast to a simple pressure rise, which would be caused by squeezing the sides of a flexible plastic container or a conventional pressure wave, which could be caused by tapping on the bottom or sides of a flexible plastic container, as described in the prior art. Neither a pressure rise nor a conventional pressure wave exhibits the essential characteristics to be considered as a hydraulic shock wave. Because the rigid water bottles which are commonly used in the bottled water industry are highly resistant to deformation, the prior art methods of squeezing or tapping would be insufficient to open a membrane seal on a rigid water bottle. Thus, the rigid water bottle must be struck sharply enough to cause a drastic change in pressure, density and particle velocity to initiate a hydraulic shock wave.

The invention allows the user to install a full water bottle onto a water dispenser without any danger of spilling. Thus, the user can slowly and carefully invert the water bottle and place it in the correct position. This is much easier and safer than the current practice, which requires speed, strength and coordination to quickly invert the unsealed bottle and place it on the water dispenser before the water gushes out. Other objects and advantages of the invention will become apparent from reading and understanding the following detailed description along with the accompanying drawings.

DETAILED DESCRIPTION OF THE PREFERRED EMBODIMENTS

As mentioned previously, the present invention is designed for use with a water bottle which is made of a rigid material. Water bottles for household and office water dispensers are commonly made in 3 gallon and 5 gallon sizes. The geometry of current water bottles varies from cylindrical to cubic. The preferred material for such water bottles is a rigid polymer, most commonly polycarbonate, but other rigid materials such as glass, polyethylene terephthalate or rigid PVC can also be used. The rigidity of the bottle material strongly resists squeezing of the bottle, which makes prior art methods that rely on squeezing a bottle to open a releasable seal ineffective. Because of the universal acceptance of rigid water bottles for water dispensers, it is important to devise a method of avoiding water spillage which is compatible with these rigid containers.

Figure 2:
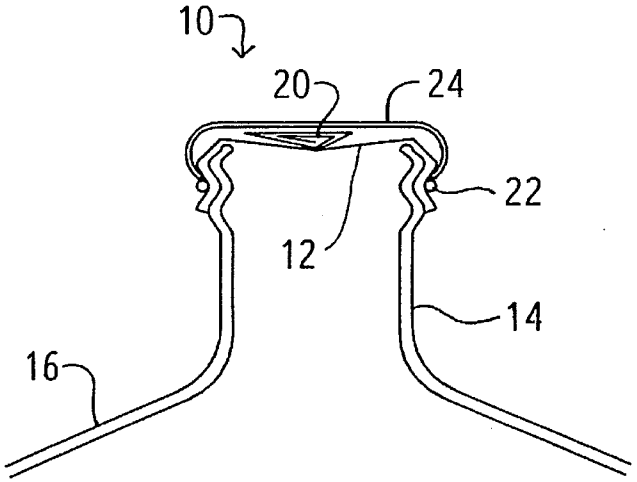
FIG. 2 shows a cross section of the folded membrane closure sealed beneath a tear-away plastic cap.
Figure 1:
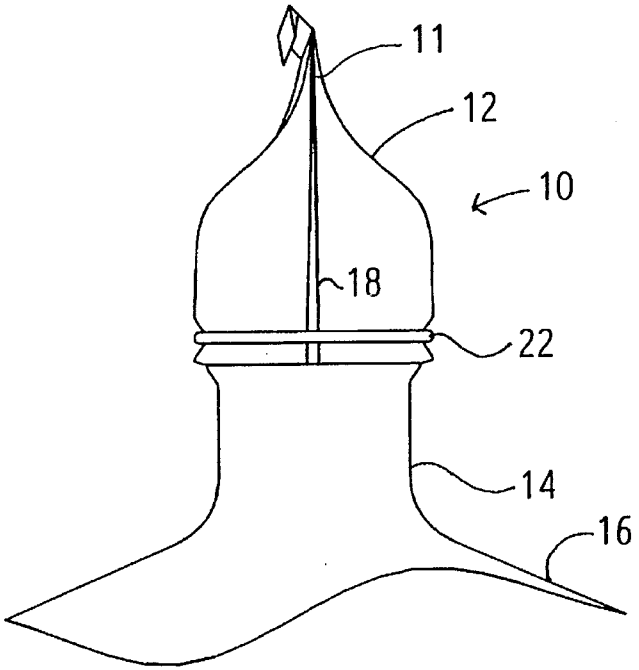
FIG. 1 shows a folded membrane closure as it is being formed.

FIG. 1 shows a folded membrane closure 10 as it is being formed. The membrane 12 can be made of almost any thin, flexible water-impermeable material, such as paper, waxed paper, plastic or aluminum foil. Aluminum foil with a thickness of 0.7 to 1.3 mils (thousandths of an inch) is the preferred material. The aluminum foil can be laminated with a polymeric layer to improve its barrier properties and to improve tear and puncture resistance. A laminate of approximately 1.0 mil thick aluminum foil with a 0.5 mil layer of low density polyethylene laminated on one or both sides has been found to be highly effective. A laminate of approximately 1.2 mil thick aluminum foil laminated on one or both sides with approximately 0.3 to 0.6 mils of saran (vinylidene chloride copolymer) has also been found to be highly effective. To form the folded membrane closure 10, the membrane 12 is first formed into a tube of approximately the same diameter as the neck 14 of the water bottle 16. The membrane 12 may be formed as a continuous tube, as by plastic extrusion, or a flat sheet of membrane material 12 may be wrapped into a tube and the edges 18 folded together or adhesively sealed to form a tube. Next, gussets 11 are folded on opposite sides of the tube, the tube is flattened out and the flattened tube is folded repeatedly. The folds may be made in a zig-zag pattern or folded repeatedly in one direction to form a roll 20 of membrane material which lays flat against the neck 14 of the bottle as shown in FIG. 2. Another effective way to complete the seal is by rolling the flattened tube around a small diameter cylindrical rod to form the roll 20 of membrane material without creases.

The folded membrane seal 10 may be formed directly on the neck of the bottle, or it may be formed separately and later attached to the bottle neck 14. The membrane 12 can be attached to the bottle neck 14 by gluing, attaching with an elastic band 22 or attaching with a ring of heat shrink material. Once the folded membrane seal 10 is attached, the bottle neck 14 can be covered with a cap 24 which may be a tear-away plastic cap like those in current use.

Figure 3B:
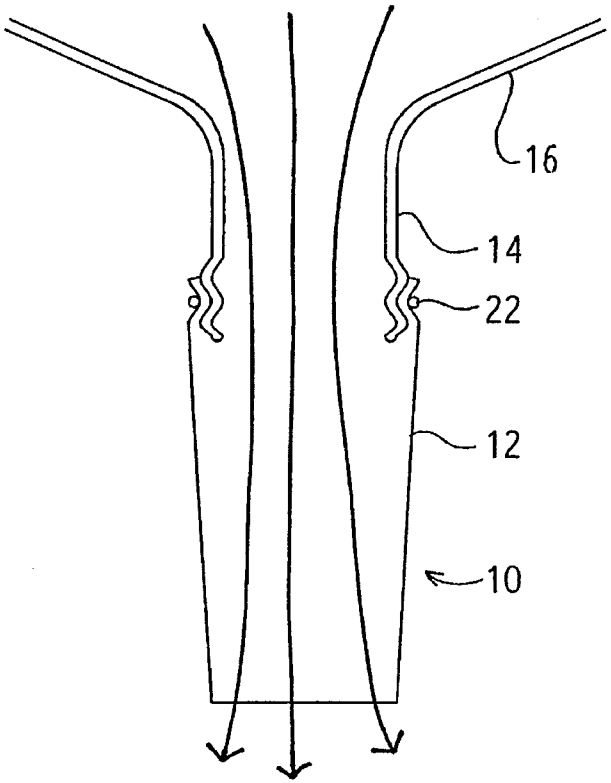
FIGS. 3A & 3B show the folded membrane closure unfolding to release the water from the bottle.
Figure 3A:
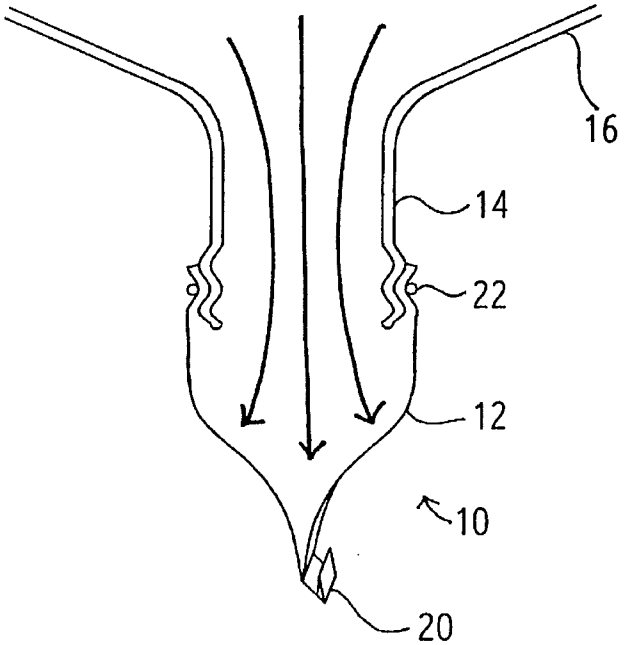

When it is time to change the water bottle 16, the user first removes the plastic cap 24. The user lifts the water bottle 16, inverts it and places it over the water dispenser. Then the user induces a hydraulic shock wave in the water within the bottle, using one of the methods that will be described is detail below. The hydraulic shock wave causes the folded seal 10 to unfold as shown in FIG. 3A, until it releases the water from the bottle as shown in FIG. 3B.

If desired, the folded membrane seal 10 can be modified by adding a weak adhesive in between the folds that will increase the resistance to unfolding, which makes the seal insensitive to inadvertent shocks during shipping and storage. Other ways of increasing the resistance to unfolding include heat setting the membrane 12 in the folded condition to create a memory in the material which resists unfolding, and embossing the material with a pattern that increases the stiffness of the membrane or causes a temporary adhesion between the sides of the membrane.

Figure 4:
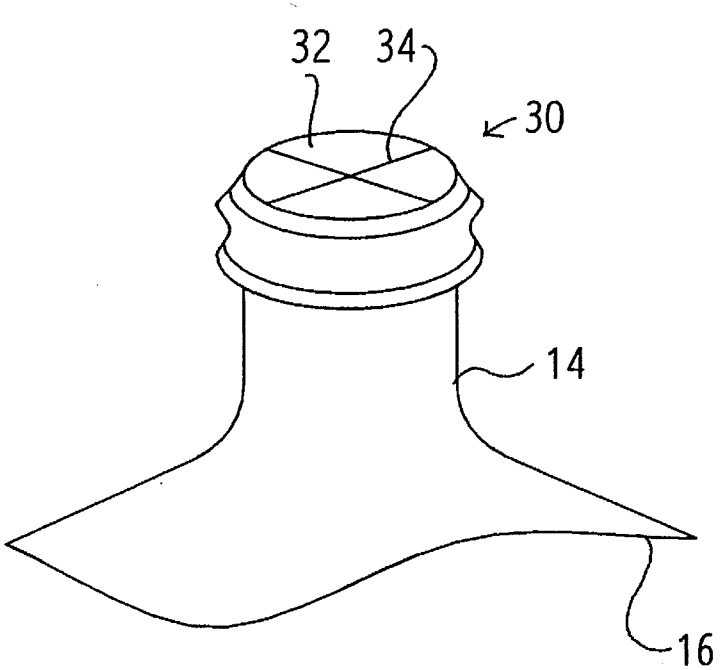
FIG. 4 shows a rupturable membrane closure with a weakened rupture pattern.

FIG. 4 shows a rupturable membrane seal 30 made in accordance with the present invention. The membrane seal 30 can be made of almost any thin, water-impermeable material 32, such as paper, waxed paper, plastic or aluminum foil. Preferably, the membrane material 32 is adhesively bonded to the neck 14 of the bottle 16. Alternatively, the membrane material 30 can be attached with an elastic band or a ring of heat shrink plastic. It is important that the membrane 32 be attached taut and leak proof across the neck 14 of the bottle 16. If desired, the rupturable membrane seal 30 can be made with a weakening pattern that defines a desired rupture pattern 34. The rupture pattern 34 can be formed by creasing or scoring the membrane material 32 to weaken it in a desired rupture pattern 34. The X-shaped rupture pattern 34 shown is just one of many possible geometries for the rupture pattern.

Figure 5:
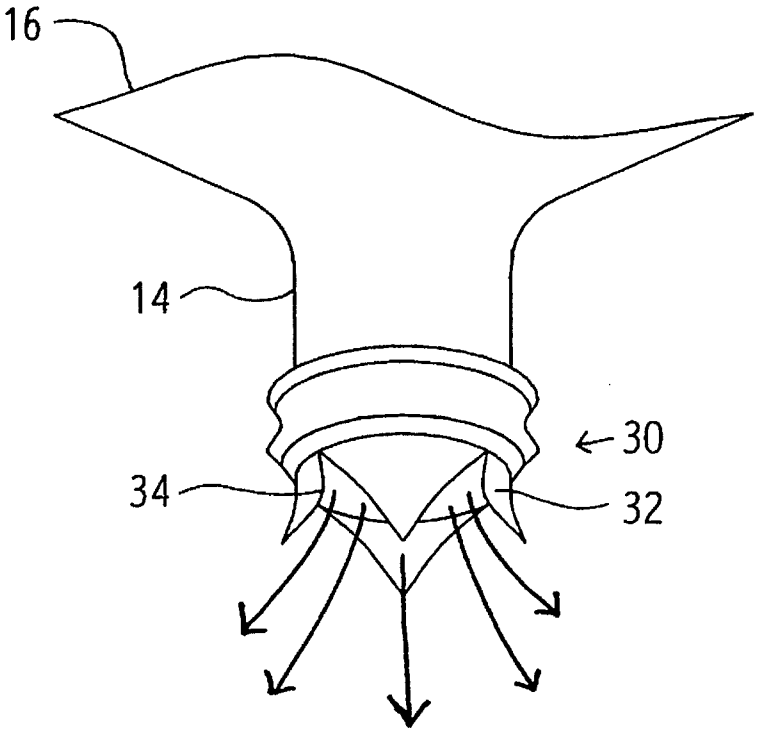
FIG. 5 shows the rupturable membrane closure rupturing to release the water from the bottle.

FIG. 5 shows the rupturable membrane closure rupturing after it is acted upon by a hydraulic shock wave to release the water from the bottle 16. The rupture pattern 34 should be chosen so that all of the membrane material 32 is retained on the bottle neck 14 when it ruptures. This will prevent inadvertent contamination of the drinking water from fragments of the membrane material.

Figure 6:
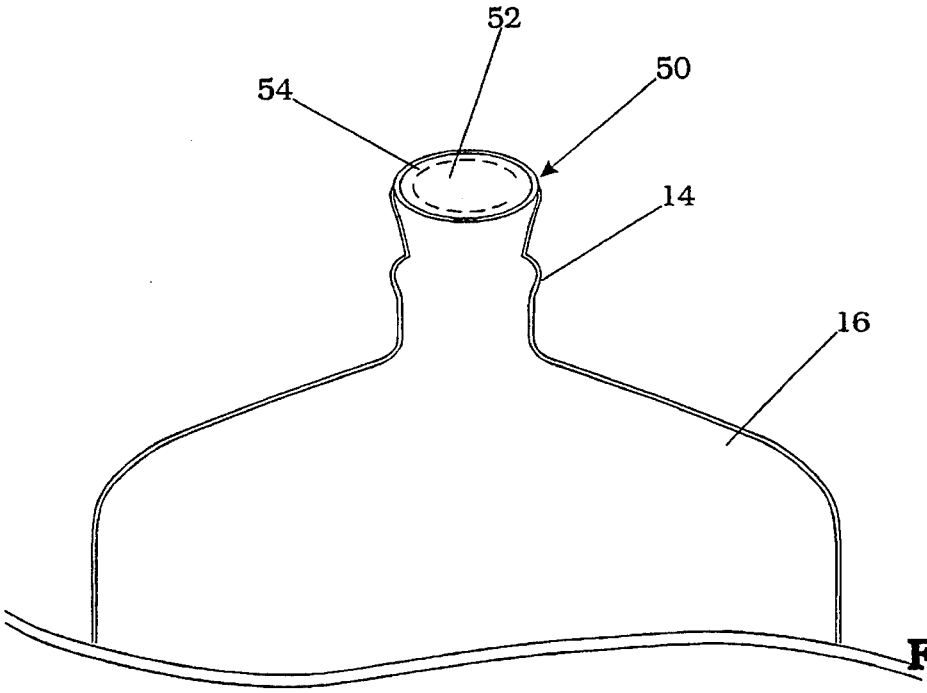
FIG. 6 shows a bottle with a perforated membrane closure.

Another method of forming a preferred rupture pattern in a rupturable membrane closure 50 is to perforate the membrane material. FIG. 6 shows a rupturable membrane 52 that has been perforated in a C-shaped rupture pattern 54. The preferred material for this embodiment is aluminum foil or plastic laminated aluminum foil, as described above. The rupture pattern 54 is made by incising the foil seal with a sharp blade to form perforations. Then, the perforated foil is rolled or rubbed to reclose the perforations. The result is a series of perforations that weaken the membrane, but which are sufficiently sealed to prevent leakage of the water from the bottle when it is inverted.

Figure 7:
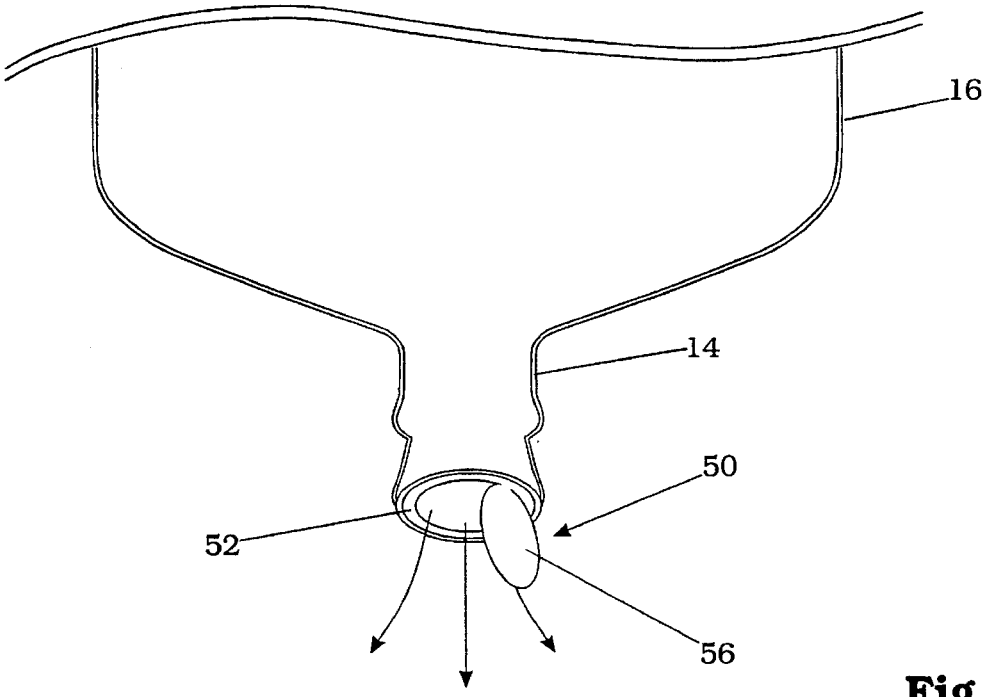
FIG. 7 shows the perforated membrane closure opening to release water from the bottle.
Figure 8:
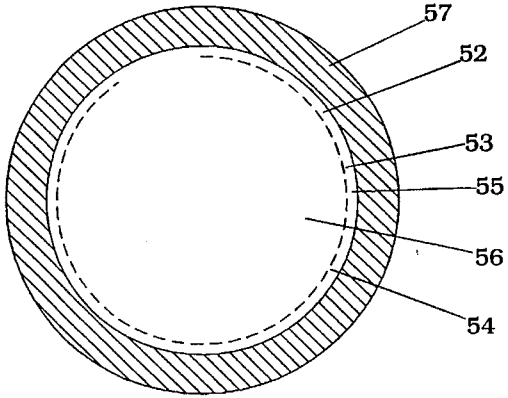
FIG. 8 is a detail drawing of the perforated membrane closure.

When the bottle 16 is inverted and a hydraulic shock wave is induced inside the bottle 16, the membrane 52 ruptures, allowing the water to flow from the bottle, as shown in FIG. 7. The flap 56 which opens is retained on the neck 14 of the bottle 16. The resistance of the membrane 52 to opening can be adjusted by varying the geometry of the rupture pattern 54 and the size of the perforations, as well as the spacing between them. The pattern shown in FIG. 8 has proven to be effective for use with 3 gallon or 5 gallon water bottles. The perforations are arranged in a C-shaped arc 54 with a diameter smaller than the periphery of the bottle neck. When either 1.1 mil thick aluminum foil or approximately 1.0 mil thick polyester film is used as the membrane material, the desired performance is achieved with a perforation pattern of approximately 2.0 mm slits 53 separated by approximately 0.2 mm spaces 55. A skirt 57 of membrane material is left around the periphery for adhesively attaching the membrane to the bottle neck.

Figure 9:
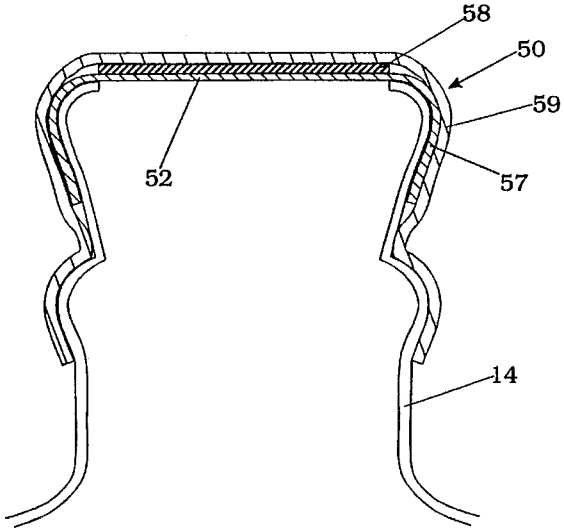
FIG. 9 shows a cross section of the perforated membrane closure with a protective disk sealed beneath a tear-away plastic cap.
Figure 13:
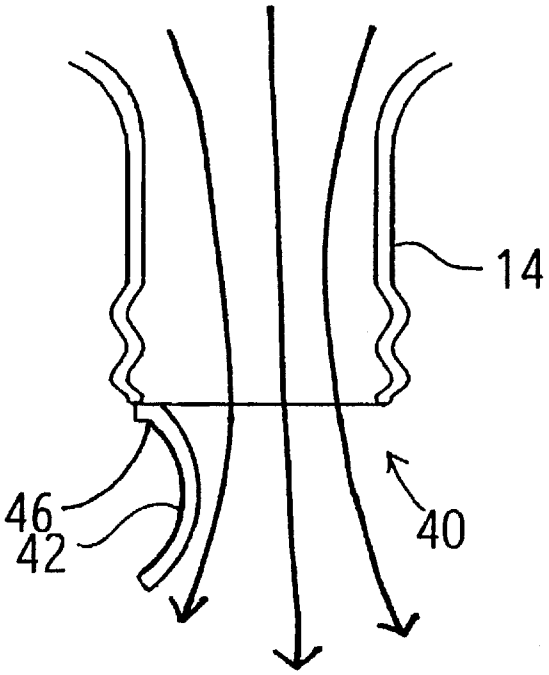
FIG. 13 shows the releasable membrane closure opening to release water from the bottle.

For protecting the perforated membrane during shipping, a protective disk 58 may be installed over the membrane before covering the membrane 52 closure with the tear-away cap 59 as shown in FIG. 9. The protective disk 58 supports the membrane 52 so that it is not affected by a positive pressure inside the water bottle during shipping and storage. To make the disk 58 effective in protecting the membrane from a positive pressure outside the bottle, a tacky adhesive can be applied to the side of the disk facing the membrane 52. The adhesive can be applied across the entire surface of the disk 58 or the adhesive can be applied in a predetermined pattern, for instance as a circle of adhesive at the center of the disk and a narrow ring of adhesive that attaches to the membrane along the perforation pattern. The adhesive supports the membrane 52 so that a pressure from outside the bottle does not cause the membrane to prematurely rupture. The disk 58 is carefully removed before the bottle is installed onto the water dispenser. The tacky adhesive should be chosen so that it peels off of the membrane without inadvertently tearing the perforations when the disk is removed. The protective disk 58, with or without the adhesive, can be used with any of the other embodiments of the membrane closure to protect them during shipping and storage.

Figure 10:
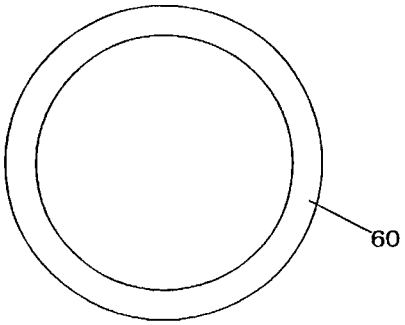
FIG. 10 is a detail drawing of a shim disk for use with the perforated membrane closure.
Figure 11:
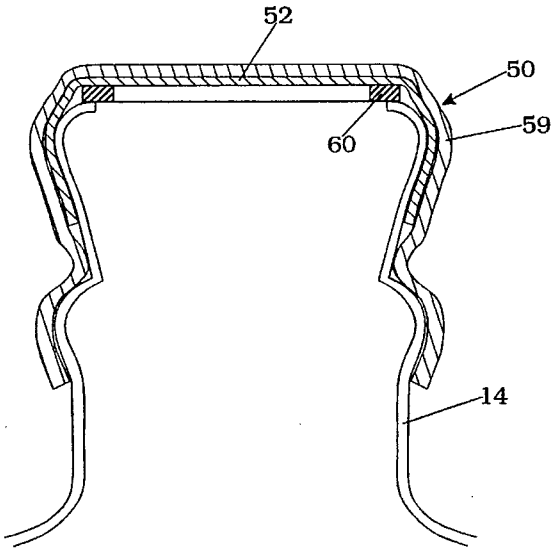
FIG. 11 shows a cross section of the perforated membrane closure with the shim disk sealed beneath a tear-away plastic cap.

Instead of, or in addition to, the protective disk 58, the closure can be made with a ring-shaped shim disk 60 which is installed between the perforated membrane 52 and the bottle neck 14. The shim disk 60, shown in FIG. 10, is a ring of material that has an outside diameter that rests on the neck of the bottle 14 and an inside diameter smaller than the diameter of the C-shaped arc of perforations. FIG. 11 shows a cross section of the perforated membrane closure 52 with the shim disk 60 sealed beneath a tear-away plastic cap 59. The shim disk 60 supports the perforated section of the membrane 52 so that a pressure from outside the bottle does not cause the membrane to rupture prematurely.

Figure 12:
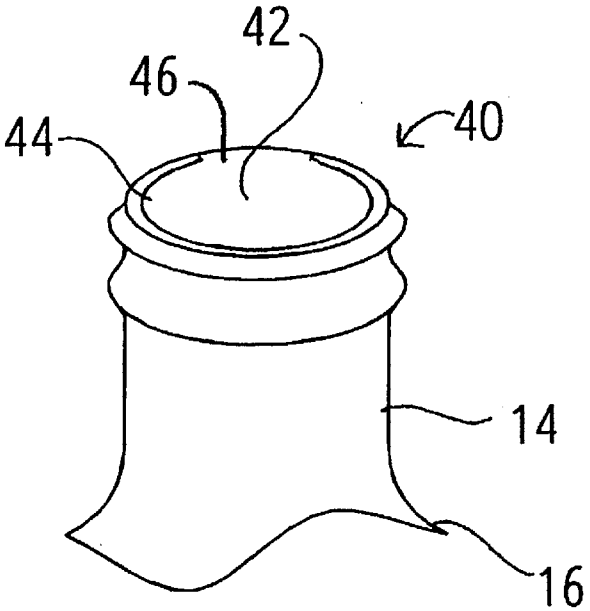
FIG. 12 shows a releasable membrane closure with differential adhesive.
Figure 14:
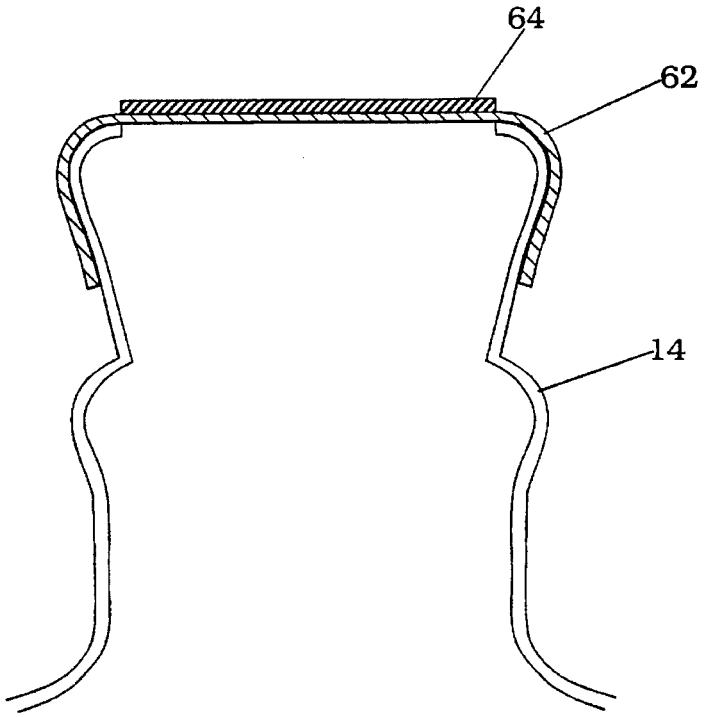
FIG. 14 shows a cross section of a membrane closure with a weighted disk which aids in the release of the membrane seal.

FIG. 12 illustrates another approach using a differential adhesive technology for the releasable membrane closure 40 for use in the present invention. This embodiment uses a membrane 42 made of foil, plastic, paper, wax paper or another water-impermeable material. The membrane is 42 is adhesively attached to the neck 14 of the water bottle 16 using two different adhesives. The greater arc 44 of the periphery of the membrane is attached with a releasable adhesive and a lesser arc 46 of the periphery is attached with a stronger non releasing adhesive. The releasable adhesive is selected so that it is strong enough to withstand the hydrostatic pressure of the water when the bottle is inverted, but will release when it is subjected to a hydraulic shock wave, as shown in FIG. 14. The stronger non releasing adhesive is selected to withstand the hydraulic shock wave so that the membrane 42 will remain attached to the neck 14 of the water bottle 16 after the seal has been opened. The releasable adhesive may be laminated directly to the membrane material or the adhesive may be applied as a double sided tape with the releasable adhesive on one side and a stronger adhesive on the other side to stick to the membrane. A suitable releasable adhesive is 3M Post-It® adhesive. The membranes with the adhesive applied are first mounted on a waxed paper carrier for ease of handling and to further decrease the tack of the adhesive. The adhesive membranes are peeled off of the wax paper carrier and applied to the mouth of the bottle.

FIG. 14 shows a further refinement of the membrane closure. The membrane closure 62 can be made more sensitive to hydraulic shock waves by attaching a weight 64 to the membrane to prestress it when the bottle is inverted. The weight 64 can be made in the form of a weighted disk or ring which is adhesively bonded to the membrane 62. The weighted disk or ring should have an outside diameter that is slightly larger than the opening of the bottle neck 14 so that the weight 64 is supported when the bottle is upright. This enhancement can be used with any of the rupturable seals, perforated seals or releasable adhesive seals described above, to make them more sensitive so that they can be opened with a lower magnitude shock wave.

All of the embodiments of the membrane closure described above are suitable for application by automated bottling equipment by the water bottling company. They can also be applied by hand to the water bottles by the end user. The membrane closures may be individually wrapped in sanitary packages. Later, when the water bottle is empty, the material of the closure can be discarded or it can be recycled to reduce material waste.

Figure 15:
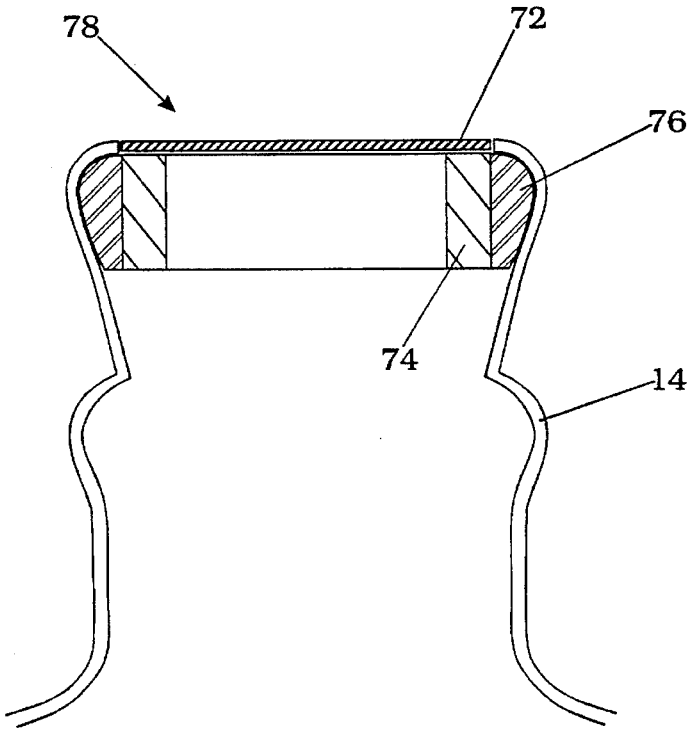
FIG. 15 shows a cross section of a membrane closure mounted on an insert ring within the neck of a bottle.

FIG. 15 illustrates an embodiment of the membrane closure which is specifically designed for application by automated bottling equipment by the water bottling company. A membrane closure, 72 which may be any of the membrane closures described above, is attached to an insert ring 74, which acts as a carrier. The insert ring 74 has a seal 76 made of a resilient rubber material around the outside of the ring. The membrane closure 72, the insert ring 74 and the seal 76 can be preassembled as a unit 78. To install the membrane closure 72, the resilient seal 76 is compressed and the assembly is inserted into the neck 14 of the bottle. When the resilient seal 76 is released it forms a watertight seal between the insert ring 74 and the bottle neck 14. This embodiment has the advantage that the entire releasable membrane closure is interior to the neck of the bottle. Thus, the closure will not interfere with any capping machinery currently used by the water bottling company. After the water bottle has been used, the insert ring assembly 78 can be removed and recycled or discarded.

OPERATIONAL DESCRIPTION

To practice the nonspill water replacement system of the present invention, the water or other fluid is provided in a rigid bottle with a releasable membrane closure as described in the various embodiments above. The membrane closure which provides an initial watertight seal to the water bottle may be installed at the bottling plant or it may be applied by the end user. When the user wishes to replace the water bottle on a water dispenser, the empty bottle is removed and a new bottle is prepared by removing any protective cap that may have been placed over the membrane closure. The full bottle is lifted, inverted and placed over the water dispenser. In order to release the watertight seal of the membrane closure, the user generates a hydraulic shock wave in the water inside the bottle. The shock wave opens the seal and allows the water to flow from the bottle. Three methods for generating the necessary hydraulic shock wave are described below.

Figure 16A:
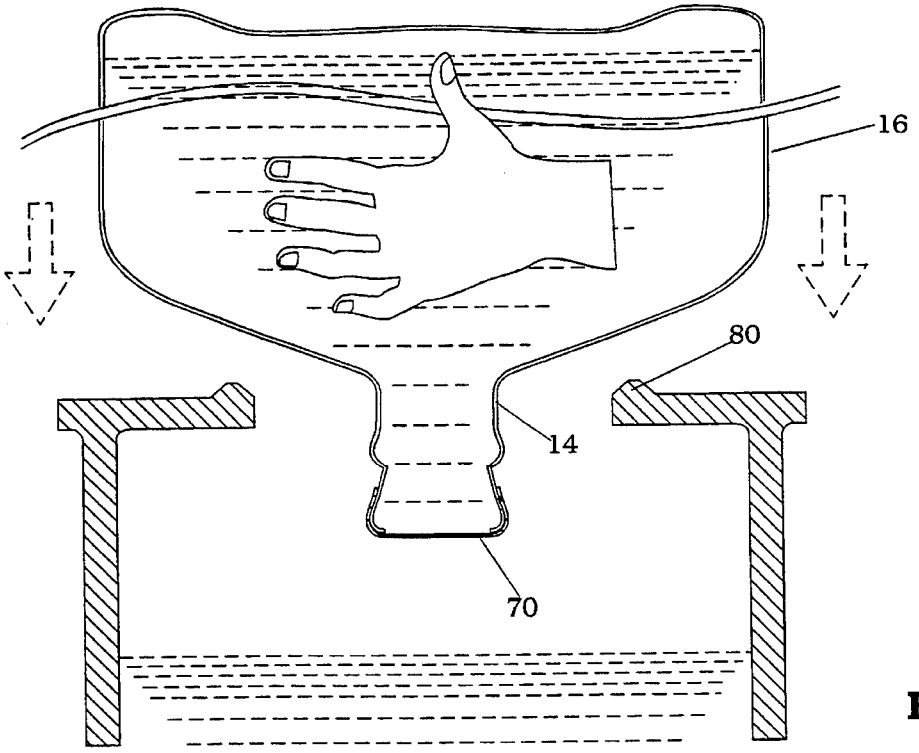
FIG. 16A & 16B illustrate a first method of creating a hydraulic shock wave to open the membrane seal.
Figure 16B:
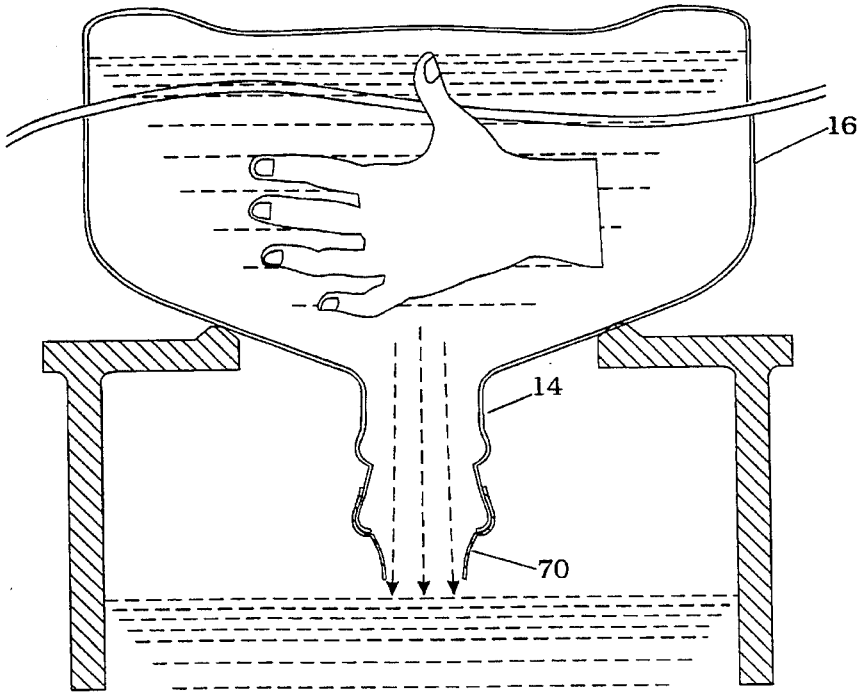

FIG. 16A & 16B illustrate a first method of creating a hydraulic shock wave to open the membrane seal 70. In this method, the water bottle 16 is positioned a few inches, typically one to four inches above the top opening of the water dispenser 80, as shown in FIG. 16A. The bottle is then lowered rapidly onto the dispenser opening 80. When the bottle 16 comes to rest on the top of the dispenser 80, the inertia of the water in the bottle creates an inertial shock wave. This inertial shock wave is concentrated by the tapered neck 14 of the bottle 16, in the manner of a hydraulic ram, so that it increases in magnitude as it travels down the neck of the bottle. When the shock wave strikes the membrane closure 70, the closure opens, allowing the water to flow from the bottle into the dispenser 80, as shown in FIG. 16B.

Figure 17A:
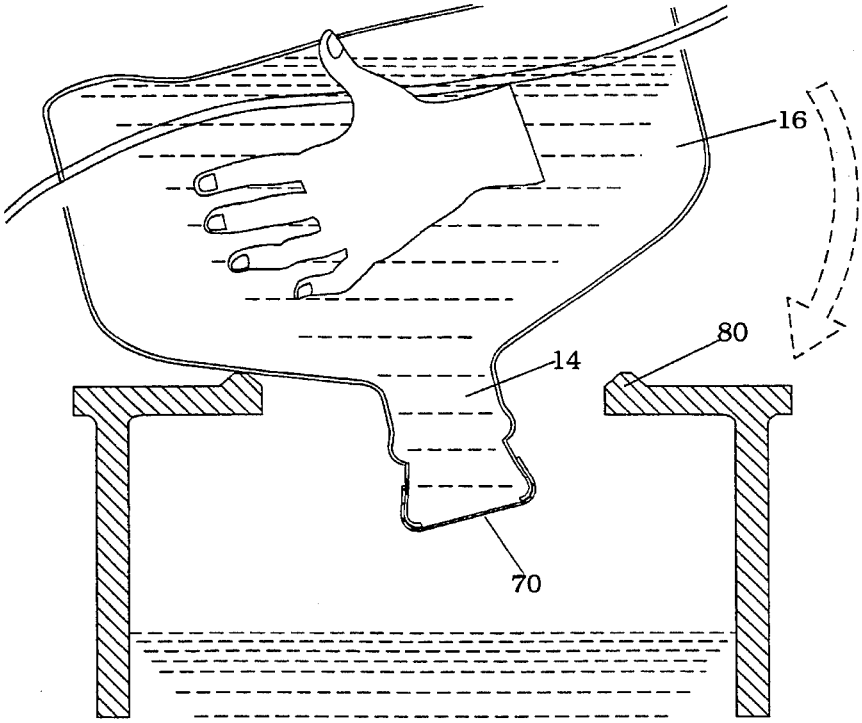
FIG. 17A & 17B illustrate a second method of creating a hydraulic shock wave to open the membrane seal.
Figure 17B:
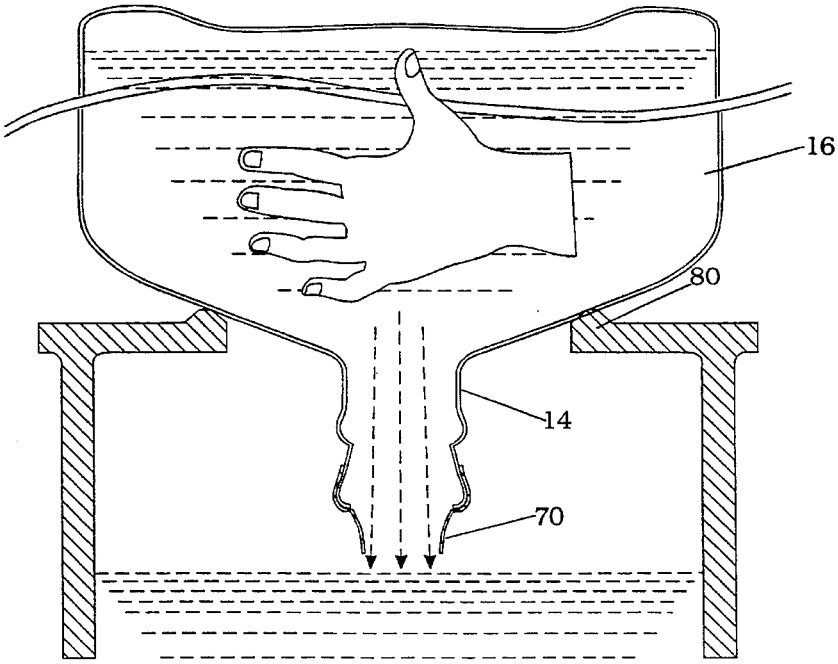

FIG. 17A & 17B illustrate a second method of creating a hydraulic shock wave to open the membrane seal 70. In this method, the water bottle 16 is placed on the top opening of the water dispenser 80 with the seal 70 intact. The bottle 16 is then tipped so that one shoulder of the bottle is a few inches, typically one to four inches above the top opening of the water dispenser 80, as shown in FIG. 17A. Then, the bottle 16 is allowed to settle back into place on top of the dispenser 80, which creates an inertial shock wave when the bottle 16 comes to rest. The shock wave is concentrated as it travels down the tapered neck 14 of the bottle 16, where it strikes the membrane closure 70 and opens it to allow the water to flow from the bottle into the dispenser 80, as shown in FIG. 17B.

Figure 18A:
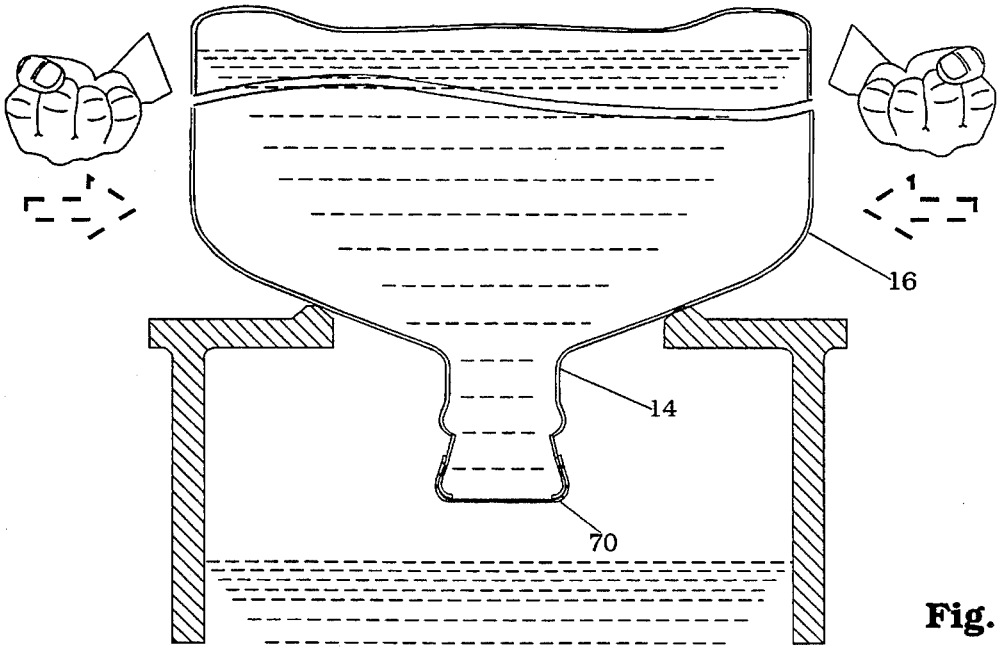
FIG. 18A & 18B illustrate a third method of creating a hydraulic shock wave to open the membrane seal.
Figure 18B:
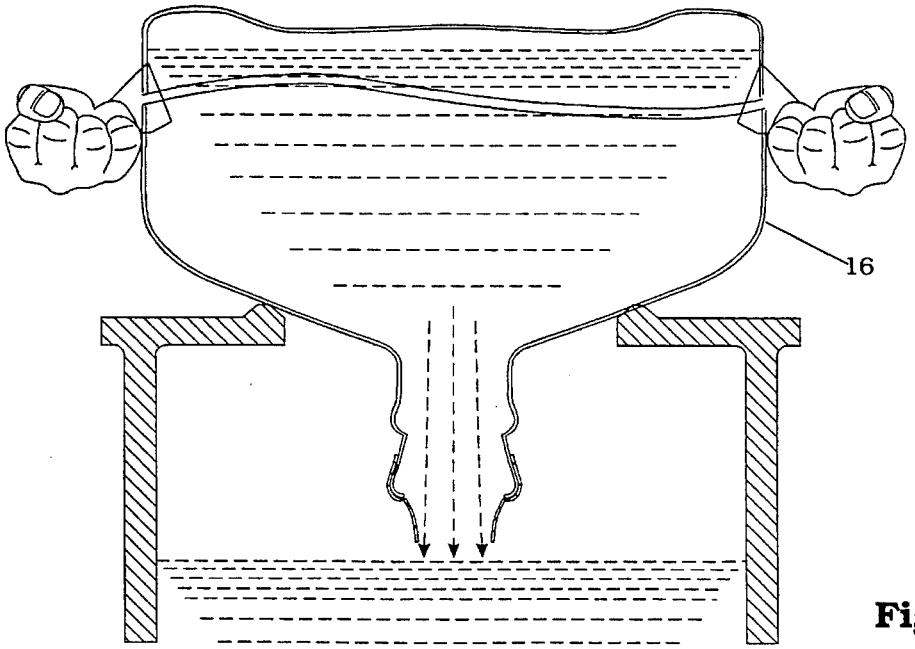

FIG. 18A & 18B illustrate a third method of creating a hydraulic shock wave to open the membrane seal 70. In this method, the water bottle 16 is placed on the top opening of the water dispenser 80 with the seal intact, as shown in FIG. 18A. The user strikes the bottom or the sides of the water bottle 16 to create a hydraulic shock wave. The user must strike the bottle sharply, simply squeezing the bottle will not create the required shock wave which is needed to open the membrane seal 70. The shock wave is concentrated as it travels down the tapered neck 14 of the bottle 16, where it strikes the membrane closure 70 and opens it to allow the water to flow from the bottle 16 into the dispenser 80, as shown in FIG. 18B.

With any one of the disclosed methods, the user can carefully place the water bottle on or over the water dispenser without danger of spillage. Then, once the bottle is safely in place, the user can initiate a hydraulic shock wave which opens the seal and allows the water to flow out. It should be noted that whichever method is used, whether it is struck by hand or by contact with the dispenser or by another object, the rigid water bottle must be struck sharply enough to cause a drastic change in pressure, density and particle velocity to initiate a hydraulic shock wave of sufficient magnitude to open the membrane seal.

Although the examples given include many specificities, they are intended as illustrative of only some of the possible embodiments of the is invention and methods for their use. Other embodiments and modifications will, no doubt, occur to those skilled in the art. Thus, the examples given should only be interpreted as illustrations of some of the preferred embodiments of the invention, and the full scope of the invention should be determined by the appended claims and their legal equivalents.

We claim:

1. A method of installing a bottle of fluid onto a fluid dispenser without spilling the fluid, comprising the steps of:

(a) providing the fluid in a rigid bottle made of a rigid material, said rigid bottle having an opening which is sealed with a releasable membrane seal which provides an initially fluid-tight seal, said releasable membrane seal being a rupturable membrane sealingly attached to said opening of said bottle, wherein said rupturable membrane is perforated to form a weakening pattern which forms a desired rupture pattern, (b) inverting said rigid bottle and positioning said opening of said rigid bottle over said dispenser, (c) inducing a hydraulic shock wave in the fluid within said rigid bottle which causes said releasable membrane seal to open, thereby allowing said fluid to flow from said rigid bottle into said dispenser.

2. A method of installing a bottle of fluid onto a fluid dispenser without spilling the fluid, comprising the steps of:

(a) providing the fluid in a rigid bottle made of a rigid material, said rigid bottle having an opening which is sealed with a releasable membrane seal which provides an initially fluid-tight seal, wherein said releasable membrane seal comprises a membrane sealingly attached to an insert ring, said insert ring being inserted into said opening of said rigid bottle, (b) inverting said rigid bottle and positioning said opening of said rigid bottle over said dispenser, (c) inducing a hydraulic shock wave in the fluid within said rigid bottle which causes said releasable membrane seal to open, thereby allowing said fluid to flow from said rigid bottle into said dispenser.

3. The method of claim 2 wherein said releasable membrane seal further comprises a ting sealing means which forms a fluid-tight seal between said insert ring and said opening of said rigid bottle.

4. The method of claim 3 wherein said hydraulic shock wave is induced by lowering said rigid bottle onto said dispenser, thereby striking said rigid bottle sharply against said dispenser at a sufficient relative velocity such that the inertia of said fluid is sufficient to cause an inertial shock wave in said fluid of sufficient magnitude to open said releasable sealing means when said rigid bottle comes to rest on said dispenser.

5. The method of claim 3 wherein said hydraulic shock wave is induced by lowering said rigid bottle onto said dispenser, tilting said rigid bottle from its equilibrium position, then allowing said rigid bottle to settle onto said dispenser, thereby striking said rigid bottle sharply against said dispenser at a sufficient velocity such that the inertia of said fluid is sufficient to cause an inertial shock wave in said fluid of sufficient magnitude to open said releasable sealing means when said rigid bottle comes to rest on said dispenser.

6. The method of claim 3 wherein said hydraulic shock wave is induced by lowering said rigid bottle onto said dispenser, then striking said rigid bottle sharply to cause a shock wave in said fluid of sufficient magnitude to open said releasable sealing means.

7. The method of claim 3 wherein said rigid bottle is made of a rigid polymeric material.

8. A method of installing a bottle of fluid onto a fluid dispenser without spilling the fluid, comprising the steps of:

(a) providing the fluid in a rigid bottle made of a rigid material, said rigid bottle having an opening which is sealed with a releasable membrane seal which provides an initially fluid-tight seal, wherein said releasable membrane seal comprises a membrane sealingly attached to said opening of said rigid bottle and a weight attached to said membrane, said weight being supported by said membrane when said rigid bottle is in an inverted position, said weight having sufficient mass to sensitize said membrane to open more readily when said rigid bottle is inverted and a shock wave induced in said rigid bottle, said weight having a maximum dimension which is greater than the dimension of said opening such that said weight is supported by said rigid bottle when said rigid bottle is in an upright position so that said weight does not sensitize said membrane to open more readily when said rigid bottle is in the upright positions, (b) inverting said rigid bottle and positioning said opening of said rigid bottle over said dispenser, (c) inducing a hydraulic shock wave in the fluid within said rigid bottle which causes said releasable membrane seal to open, thereby allowing said fluid to flow from said rigid bottle into said dispenser.

9. A method of installing a bottle of fluid onto a fluid dispenser without spilling the fluid, comprising the steps of:

(a) providing the fluid in a bottle made of a rigid material, said bottle having an opening which is sealed with a releasable membrane seal which provides an initially fluid-tight seal, (b) inverting said bottle and positioning said opening of said bottle over said dispenser, (c) inducing a hydraulic shock wave in the fluid within said bottle which causes said releasable membrane seal to open, thereby allowing said fluid to flow from said bottle into said dispenser, (d) providing the sealed bottle with a protective disk which overlies said releasable membrane seal, said protective disk being adhesively bonded to said releasable membrane seal with a releasable adhesive, and a removable cap which overlies said protective disk, (e) prior to inverting said bottle, removing said cap and said protective disk.

10. The method of claim 9 wherein said bottle is a rigid bottle.

* * * * *